United States Patent [19]

Kaneko et al.

[11] Patent Number: 4,724,958

[45] Date of Patent: Feb. 16, 1988

[54] TAPE-LIKE ELECTRONIC COMPONENT PACKAGE

[75] Inventors: Fumihiko Kaneko; Koichi Saito, both of Nagaokakyo, Japan

[73] Assignee: Murata Manufacturing Co., Ltd., Japan

[21] Appl. No.: 944,340

[22] Filed: Dec. 19, 1986

[30] Foreign Application Priority Data

Dec. 28, 1985 [JP] Japan ..... 60-297547

[51] Int. Cl.[4] ..... B65D 73/02; B65D 85/42

[52] U.S. Cl. ..... 206/330; 206/334; 206/461; 206/538; 206/332

[58] Field of Search ..... 206/328, 330, 532, 538, 206/461, 329, 332

[56] References Cited

U.S. PATENT DOCUMENTS

| | | | |
|---|---|---|---|
| 2,012,405 | 8/1935 | Salfisberg | 206/532 |
| 3,302,775 | 2/1967 | Finkelston et al. | 206/532 |
| 3,608,711 | 9/1971 | Wiesler et al. | 206/330 |
| 3,743,084 | 7/1973 | Douglas | 206/532 |
| 4,450,959 | 5/1984 | Sommer | 206/538 |
| 4,568,416 | 2/1986 | Okui et al. | 206/330 |

FOREIGN PATENT DOCUMENTS

| | | | |
|---|---|---|---|
| 3231300 | 2/1984 | Fed. Rep. of Germany | 206/328 |

*Primary Examiner*—Joseph Man-Fu Moy

*Attorney, Agent, or Firm*—Ostrolenk, Faber, Gerb & Soffen

[57] ABSTRACT

In a taped electronic component series provided with concavities (4, 5; 15, 16, 17) in a plurality of lines, the concavities of the respective lines are made to deviate from each other by length corresponding to the product of the arrangement pitch (P) of the concavities in each line and the inverse of the number of the lines along the longitudinal direction of the receiving tape (1; 11), so that the electronic components received in the concavities are placed in a withdrawal position one by one by feeding the taped electronic component series at a constant pitch for withdrawing the electronic components (3; 18) from the concavities.

10 Claims, 2 Drawing Figures

TAPE-LIKE ELECTRONIC COMPONENT PACKAGE

BACKGROUND OF THE INVENTION

1. Field of the Invention

The present invention relates to a tape-like electronic component package receiving electronic components in a plurality of cavities distributed along the longitudinal direction of a receiving tape, and more particularly, it relates to an improvement which makes it possible to withdraw electronic components from a tape-like package provided with a plurality of rows of cavities distributed along the longitudinal direction of the package.

2. Description of the Prior Art

A tape-like electronic component package, which can be directly mounted on an automatic apparatus and fed at a constant pitch so that the electronic components are picked up in a prescribed position and then supplied to a desired printed circuit board or the like, is conveniently employed in automated assembling steps of the electronic components.

Generally, tape-like electronic component package comprise a receiving tape having a plurality of cavities provided in a row. In general, such package are spirally wound around reels to be mounted on an automatic feed apparatus. The reels are prepared as a function of the types and numbers of electronic components required for a printed circuit board for example, so that the tape-like electronic component package is drawn out from the respective reels (are stored on reels and drawn out therefrom) arranged in coaxially.

In general, a number of electronic components of the same type are mounted on a printed circuit board such that, for example, between 10 and 50 of a total of 100 electronic components used in the circuit board are of the same type. When, in this case, the electronic components of the same type are picked up from a tape-like electronic component package drawn out from a reel, the reel is emptied in a short time thereby increasing the frequency at which the reel must be changed. The entire apparatus must be stopped to exchange such a reel, whereby the rate of operation is reduced.

In order to reduce the time required for reel exchange to the minimum, spares for the reel supplying a large number of electronic components are prearranged in a reel set position as a function of the number of the electronic components as required. While this reduces the space requirements for the reels, the apparatus must still inevitably be stopped every time a reel is emptied.

On the other hand, there has been proposed a tape-like electronic component package which comprises a receiving tape provided with a plurality of rows of cavities (e.g., U.S. Pat. No. 4,298,120, FIG. 8). In this case, a larger number of electronic components can be supplied from one reel, whereby the area efficiency is improved.

However, while the aforementioned package is provided with a plurality of rows of cavities, the cavities of each row are aligned in the cross direction of the receiving tape. Therefore, when a cover sheet for covering openings of the cavities is stripped from an end in the longitudinal direction thereof in order to withdraw the electronic components from the cavities, the plurality of cavities aligned in the cross direction of the receiving tape are simultaneously exposed. In theory, the plurality of electronic components may ideally be picked up from the simultaneously exposed cavities by driving a plurality of chucks at once. In practice, such an operation is impossible. Even if a plurality of cavities are simultaneously exposed, as a practical matter the electronic components must be picked up one by one. Thus, the electronic component of the set which is to be picked up second may fall out of the cavities or inclined relative to the cavity due to an external influence such as vibration or the like. The electronic components cannot be properly picked up in such a state.

SUMMARY OF THE INVENTION

Accordingly, it is an object of the present invention to provide a tape-like electronic component package having a plurality of rows of cavities, which can solve the aforementioned problem.

To this end, tape-like electronic component package of the present invention comprises a receiving tape having a plurality of cavities respectively receiving electronic components, which cavities are distributed at equal intervals along the longitudinal direction of the receiving tape in a plurality of rows as hereinabove described, and the aforementioned problem is solved by offsetting the cavities of the respective rows with respect to each other in the longitudinal direction of the receiving tape by a length corresponding to the product of the arrangement pitch of: (1) the cavities in each row and (2) the inverse of the number of rows.

According to the present invention, the cavities of the respective rows are made to deviate from each other along the longitudinal direction of receiving tape, thereby ensuring that no more than one cavity which is filled is entirely exposed at any one time as a cover tape is stripped successively from an end thereof, for example. In other words, when a single cavity is entirely exposed, the remaining cavities still containing the electronic components are not entirely exposed although they may be partially exposed. Thus, when the electronic components are picked up one by one in a successive manner, subsequent electronic components will not fall out of the cavities nor be inclined with respect to the cavities.

The deviation (offset) between the cavities of the respective rows is selected to be a length which corresponds to the pitch of the cavities in each row divided by the number of rows, whereby the taped electronic component series can be fed at the same pitch in order to withdraw the electronic components from the cavities. Thus, the conventional automatic apparatus can be directly employed by merely changing the feed rate by dividing one by the general integral number.

Further, the effect of the cavities provided in a plurality of rows is maintained to reduce the rate at which the tape-like electronic component package must be replaced and to improve the operation rate of the apparatus. In addition, the area efficiency can be improved in comparison with the case of separately preparing the tape-like electronic component package. The electronic components can be fed by one feeding apparatus in a larger number than the case of independently feeding a plurality of tape-like electronic component package, whereby the number of feeding apparatuses can be decreased to reduce the cost for the automatic apparatus. Further, the amount of material required to form the electronic component package with a prescribed number of electronic components can be reduced thereby further reducing costs. No specific technique is required in handling of the package in the automatic apparatus and steps for fabricating the package whereby the package can be manufactured with substantially direct application of the known techniques.

DESCRIPTION OF THE PREFERRED EMBODIMENTS

Figure 1:
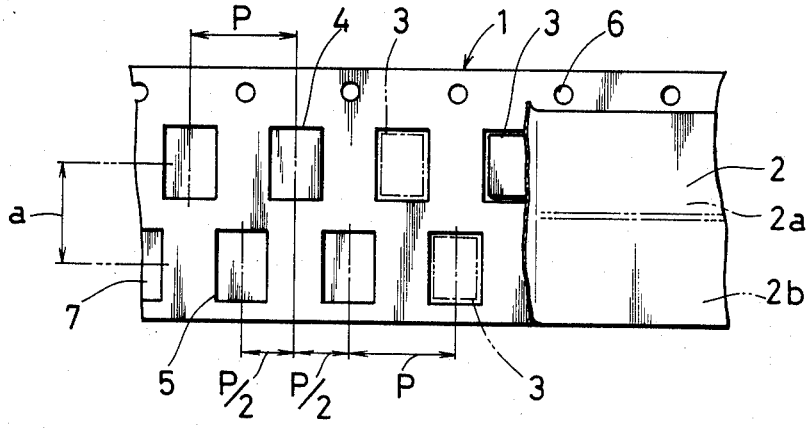
FIG. 1 is a top plan view showing an embodiment of the present invention.

FIG. 1 is a top plan view partially showing a tape-like electronic component package according to an embodiment of the present invention. The tape-like electronic component package shown in the figure comprises a receiving tape 1 and a cover tape 2, similarly to the conventional tape-like packages. The receiving tape 1 is provided with a plurality of cavities 4 and 5 for receiving, e.g., chip-like electronic components 3 respectively, which cavities 4 and 5 are distributed at equal intervals along the longitudinal direction of the receiving tape 1 in two lines. The receiving tape 1 is further provided with a plurality of feeding perforations 6 which are distributed at regular intervals longitudinally along the receiving tape 1 in association with the pitch of the cavities 4 and 5.

The receiving tape 1 is formed by cardboard for example, and the cavities 4 and 5 are provided as apertures passing through the receiving tape 1, while the bottom portions of the cavities 4 and 5 are covered by a bottom tape 7 which is adhered to the receiving tape 1 in a similar manner to the cover tape 2. Namely, the cover tape 2 and the bottom tape 7 are formed by sheets of thermoplastic resin for example, which are adhered to the receiving tape 1 through a heat seal method or by an adhesive agent.

The receiving tape 1 may be formed by a sheet of thermoplastic resin to be provided with cavities 4 and 5 having bottom portions through embossing finish, as shown in FIG. 10 of the aforementioned U.S. Pat. No. 4,298,120, for example. Further, the receiving tape 1 may be formed by a relatively thick molded resin sheet which has been provided with concavities 4 and 5 having bottom portions in the stage of molding, as shown in FIG. 9 of the said U.S. patent.

As hereinabove described, the cavities 4 and 5 are distributed at equal intervals along the longitudinal direction of the receiving tape 1 in two lines. Both of the cavities 4 of the first line and the cavities 5 of the second line are arranged with the arrangement pitch "P". The feature of this embodiment resides in deviation in arrangement of the cavities 4 of the first line and the cavities 5 of the second line. For example, the cavities 5 of the second line are made to deviate from the cavities 4 of the first line by length corresponding to the pitch "P" divided by the number of rows, i.e., by "P/2" along the longitudinal direction of the receiving tape 1.

The positional relation between the cavities 4 of the first line and the feeding perforations 6 is preferably adapted to the general standard.

In order to withdraw the electronic components 3 from the tape-like electronic component package as shown in FIG. 1, the cover tape 2 is stripped from the receiving tape 1. Thus, the cavities 4 of the first row and the cavities 5 of the second row are alternately exposed sequentially as 4, 5, 4, . . . for example, so that the electronic components 3 can be successively picked up from the cavities 4 and 5. In the state as shown in FIG. 1, the cover tape 2 has been stripped to expose an electronic component 3 contained in a cavity 4 of the first row after the electronic component 3 has been picked up from cavity 5 of the second row. In this stage, a subsequent cavity 5 of the second line is still covered by the cover tape 2, to retain the electronic component received therein in a prescribed position.

Figure 2:
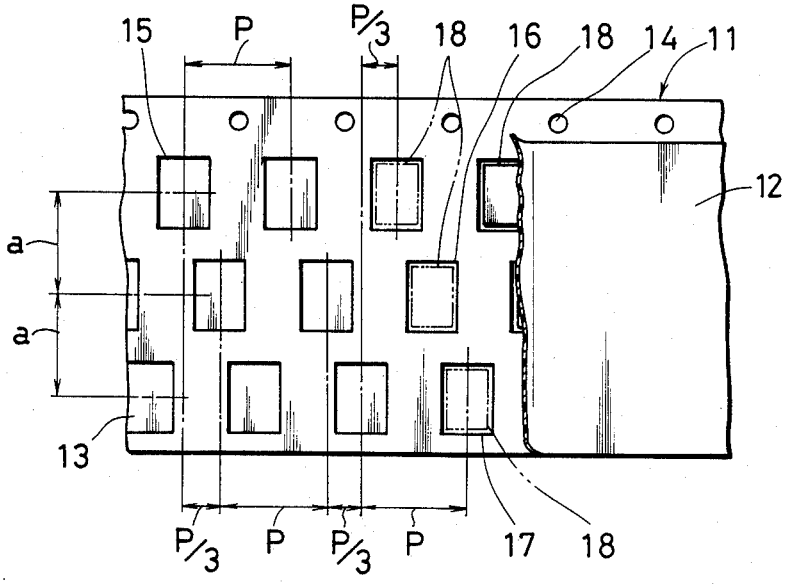
FIG. 2 is a top plan view showing another embodiment of the present invention.

FIG. 2 is a top plan view showing another embodiment of the present invention. This embodiment is characterized in that three rows of cavities are provided.

A taped electronic component series of this embodiment also comprises a receiving tape 11, a cover tape 12 and a bottom tape 13, and the receiving tape 11 is provided with feeding perforations 14. The receiving tape 11 is further provided with cavities 15, 16 and 17 distributed at equal intervals along the longitudinal direction of the receiving tape 11 in three rows. The cavities 15, 16 and 17 receive electronic components 18 respectively.

The mode of arrangement of the cavities 15, 16 and 17 in this embodiment is selected as follows: For example, the cavities 16 of the second row are made to deviate from the cavities 15 of the first row by length "P/3" corresponding to the product of the arrangement pitch "P" of the concavities of each line and the inverse of the number 3 of the rows, i.e., "$\frac{1}{3}$" along the longitudinal direction of the receiving tape 11. Similarly, the cavities 17 of the third row are made to deviate from the cavities 16 of the second row by the same length "P/3", while the cavities 15 of the first row are made to deviate from the cavities 17 of the third row by the same length "P/3".

Thus, as the cover tape 12 is stripped from the receiving tape 11, the cavities 15, 16 and 17 of the first, second and third rows are exposed sequentially as 15, 16, 17, 15, . . . .

The tape-like electronic component package as shown in FIGS. 1 and 2 are mounted on an automatic apparatus and fed in the following manner so that the electronic components may be withdrawn from the cavities. For example, the tape-like electronic component package of FIG. 1 is fed by "P/2" in the longitudinal direction of the receiving tape 1 and then fed by length "a" corresponding to the distance between the respective rows of concavities 4 and 5 in the cross direction of the receiving tape 1, so that all of the electronic components are picked up by a chuck driven in a fixed position. In the taped electronic component series of FIG. 2, the receiving tape 11 is fed by a distance "P/3" in its longitudinal direction, and then fed by the distance "a" in its cross direction. Thus, the electronic components 3 or 18 are picked up by one chuck in a fixed position.

When the aforementioned feeding method is employed, the distance "a" between the first and second rows of the tape-like electronic component package as shown in FIG. 2 is equalized to that between the second and third rows, as well as to that between the rows of the taped electronic component series as shown in FIG. 1, for convenience.

Although the tape-like electronic component package is fed in the cross directions in the aforementioned embodiments, the chuck may alternatively be moved in the cross directions of the package.

While the cavities are provided in two rows and three rows in the aforementioned embodiments, the number of the rows may be further increased. The cavities are preferably provided in two to five rows in practice.

The cavities are not necessarily exposed by stripping the cover tape in sequence of the rows as first row, second row, . . . , but may be exposed in arbitrary sequence such as first row, third row, second row, . . . .

The cover tape 2 covers all of the cavities 4 and 5 in the embodiment as shown in FIG. 1 while the cover tape 12 covers all of the cavities 15, 16 and 17 in the embodiment as shown in FIG. 2. Alternatively, two separate cover tapes 2*a* and 2*b* as shown by phantom lines may be employed in the embodiment as shown in FIG. 1, for example. This also applies to the embodiment as shown in FIG. 2.

Further, the types of electronic components received in a single tape-like electronic component package may be varied with the rows. Therefore, the geometry or the size of the cavities may be varied with the types of various electronic component packages.

Although the present invention has been described and illustrated in detail, it is clearly understood that the same is by way of illustration and example only and is not to be taken by way of limitation, the scope of the present invention being limited only by the terms of the appended claims.

What is claimed is:

1. A tape-like electronic component package comprising:

an elongated receiving tape having a plurality of rows of cavities, each row extending in a longitudinal direction of said receiving tape, said cavities of each row being distributed along said longitudinal direction with a predetermined pitch, cavities of respective rows being offset with respect to cavities of said other rows by a length as measured in said longitudinal direction equal to a multiple of said pitch and the inverse of the number of said rows;

a respective electronic component located in each said cavity; and cover tape means enclosing said cavities.

2. A tape-like electronic component package in accordance with claim 1, wherein said number of said rows is 2.

3. A tape-like electronic component package in accordance with claim 1, wherein said number of said rows is at least 3.

4. A tape-like electronic component package in accordance with claim 3, wherein the distance between each adjacent pair of rows of said cavities as measured in a direction perpendicular to said longitudinal direction of said tape is equal to each other.

5. A tape-like electronic component package in accordance with claim 3, wherein each cavity of each row is associated with a respective cavity of the remaining rows and where associated cavities of each row fall along a straight line which is oblique to said longitudinal direction of said receiving tape.

6. A tape-like electronic component package in accordance with claim 1, wherein said cover tape means comprises a single cover tape adhered to said receiving tape to cover said cavities of all of said rows.

7. A tape-like electronic component package in accordance with claim 1, wherein said cover tape means comprises a plurality of cover tapes adhered to said receiving tape, each of said cover tape covering all of said cavities of a respective said row.

8. A tape-like electronic component package in accordance with claim 1, wherein said number of said rows is 3.

9. A tape-like electronic component package in accordance with claim 1, wherein said number of said rows is 4.

10. A tape-like electronic component package in accordance with claim 1, wherein said number of said rows is 5.

* * * * *